United States Patent [19]

Santianni

[11] 4,023,807

[45] May 17, 1977

[54] ELECTRIC GAME SET

[76] Inventor: Blaise F. Santianni, 807 Glenview St., Philadelphia, Pa. 19111

[22] Filed: Mar. 1, 1976

[21] Appl. No.: 662,958

[52] U.S. Cl. ..... 273/130 AB; 35/9 D; 273/130 G

[51] Int. Cl.² ..... A63F 3/00

[58] Field of Search .... 273/130 AB, 130 G, 131 A, 273/131 BB, 134 A, 134 AC, 135 A, 135 AB, 136 A, 137 A; 35/9 C, 9 D

[56] References Cited

UNITED STATES PATENTS

| | | | |
|---|---|---|---|
| 2,505,230 | 4/1950 | Composto | 35/9 D |
| 2,853,799 | 9/1958 | Magnussen et al. | 35/9 D |
| 2,860,422 | 11/1958 | May | 35/9 C |
| 2,872,741 | 2/1959 | Krueger et al. | 35/9 D |
| 3,252,230 | 5/1966 | Donev | 35/9 D |
| 3,653,668 | 4/1972 | Santianni | 273/135 AB |
| 3,863,931 | 2/1975 | Forsyth et al. | 273/130 AB |

FOREIGN PATENTS OR APPLICATIONS

| | | | |
|---|---|---|---|
| 1,149,933 | 7/1957 | France | 273/130 AB |

*Primary Examiner*—Anton O. Oechsle
*Assistant Examiner*—Harry G. Strappello
*Attorney, Agent, or Firm*—Benasutti Associates, Ltd.

[57] ABSTRACT

A game set comprises a board having indicia which relate to indicia on individual pieces which can be associated with the board. There is an interconnection between the pieces and electrical impulse means also associated with the board whereby if the pieces are placed in incorrect positions on the board the impulse means will respond, such as by actuating a buzzer. The connections are identical, but the pieces need not be.

2 Claims, 5 Drawing Figures

ELECTRIC GAME SET

BACKGROUND OF THE INVENTION

I previously invented a game board apparatus which is the subject of U.S. Pat. No. 3,653,668, issued Apr. 4, 1972. In accordance with the apparatus, geographic areas were divided into a number of pieces for the purpose of making a game. The pieces were similar in shape and were placed on the grid playing surface. They normally had indicia thereon relating one to another; but lacking such indicia they had no definite fixed relationship to one another in and of themselves. In several cases indicia on the playing surface related to particular indicia on a playing piece so that it was easier to place that piece on the board in the correct position than it was to place the run of the mill pieces which did not have such indicia on them.

One of the factors to be considered in playing the game in accordance with may prior invention is that a plurality of pieces can be placed on the board in incorrect positions even though they are related to one another, before the error is detected and the pieces are removed. Accordingly, it is desirable to have some means of readily detecting the error in piece placement, the instant that it is put in the incorrect position on the board; so that it can be immediately removed before the error is compounded by the placement of additional pieces.

SUMMARY OF THE INVENTION

I have solved the above problem by providing a game board and associated pieces with interconnecting means for actuating an electronic signal to advise a player that a piece is in an incorrect position. This means can be adapted to games of various sizes and numbers of pieces in accordance with a mathematical formula. The means is both safe and efficient, and provides the desired ends of my invention while at the same time giving a wide range of variations. In the preferred embodiment it comprises a plurality of pins extending from each piece for insertion into mating holes in the game board. When the piece is in the correct position the pins merely serve to position the piece on the board. When the piece is in an incorrect position the board is wired to be actuated by a pin so that a signal is produced advising the player that the piece is incorrectly positioned.

Accordingly, an object of my invention is to improve upon the game described in my prior U.S. Pat. No. 3,653,668, by providing a means for instantly advising a player when a piece is incorrectly positioned with respect to the game board.

A further object of my invention is to provide an electronic game set which can be used as an educational tool and which provides a wide range of variables for this purpose, as will be more fully described hereinafter.

These and other objects will become apparent from the following description with reference to the accompanying drawings.

DESCRIPTION OF THE PREFERRED EMBOIMENT

Figure 1:
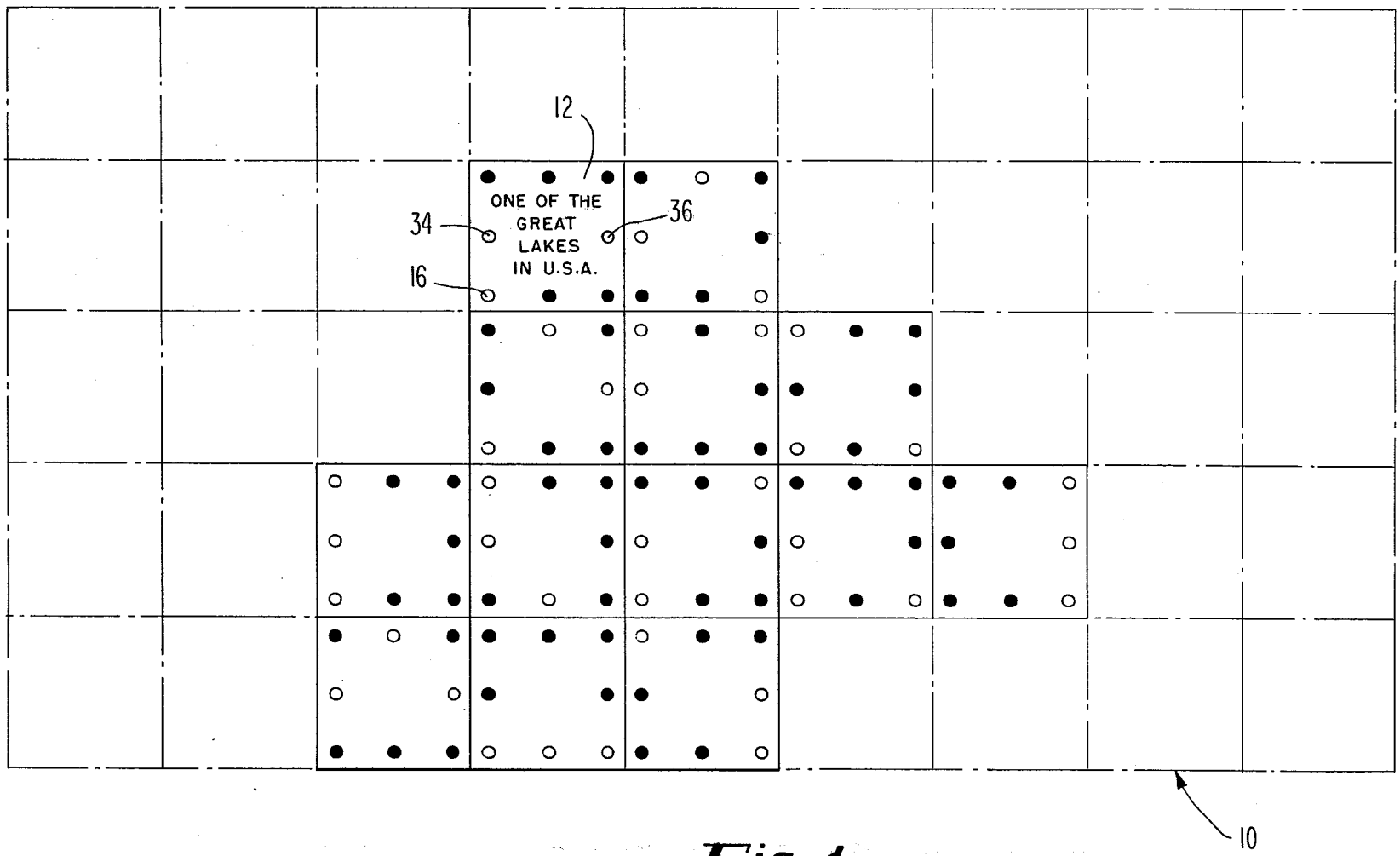
FIG. 1 is a diagrammatic plan view of the layout of a portion of a playing surface of a game board in accordance with my invention with a number of areas for reception of playing pieces being illustrated schematically.

Although specific forms of the invention have been selected for illustration in the drawings, and the following description is drawn in specific terms for the purpose of describing these forms of the invention, this description is not intended to limit the scope of the invention which is defined in the appended claims.

Reference is made to my prior U.S. Pat. No. 3,653,668, issued Apr. 4, 1972, the disclosure of which is incorporated herein by reference as if fully set forth. In accordance with that disclosure a game may be provided comprising a playing surface having a geographical area illustrated thereon in outline. The bulk of the geographical area defined by the outline is divided into a matrix of similarly shaped areas; squares or rectangles being the simplest pattern to maintain the exact repetitive pattern of a pin hole matrix, to be described more fully hereinafter in connection with the present invention. For example, if the outline is the U.S., the boundaries of the Great Lakes, the coastlines and the major rivers, such as the Mississippi, can be shown on the outline. The remainder is blank except for the layout showing the squares.

Playing pieces are provided with indicia which would fill in the remainder of the geographical landmarks for that area. For example, in the patent there is shown a portion of the state of Wyoming and Montana. These playing pieces have indicia which relate them to a specific position on the playing surface, but do not necessarily relate directly to indicia on the board. That is, in using this game it is possible to put down a number of pieces which physically (that is, by their shape or size) relate to one another or to the matrix on the board, but do not correctly relate to their predetermined correct position on the playing surface and therefore, until it is determined that the pieces are in the wrong position, play could continue.

In accordance with the present invention, that playing surface matrix is used with an added feature. Referring to FIG. 1 of the present application, note that the matrix is shown in broken lines designated generally 10. The matrix would be on the playing surface of a game board (for example). I have not illustrated the board in detail, but have shown a portion in section in FIG. 3 at 14. For purposes of illustrating particular areas, such as the area 12, solid lines have been used.

Figure 2:
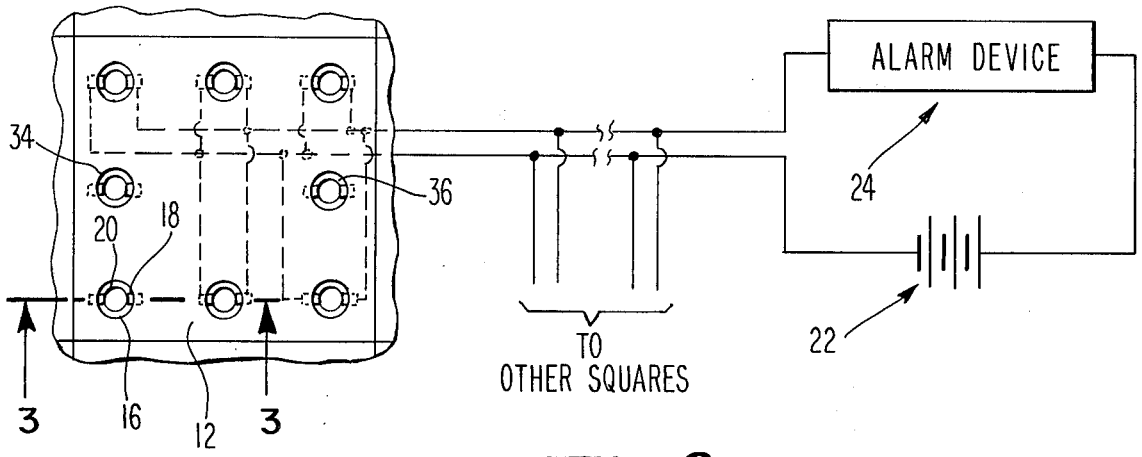
FIG. 2 is an enlarged view of a single playing area taken in plan and illustrated on a fragment of the board, shown broken away, with the electrical portion shown schematically.
Figure 3:
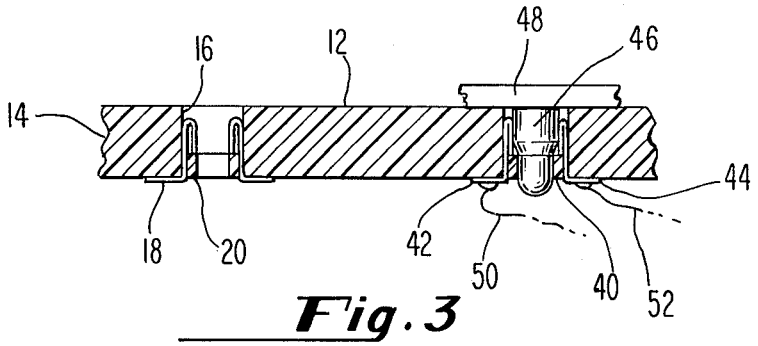
FIG. 3 is an enlarged section taken as indicated by the lines and arrows 3—3 in FIG. 2.

Referring now also to FIGS. 2 and 3 of the present application, it will be noted that each area has certain common characteristics. For example, the area 12 has eight holes in it which pass through the upper surface of the board 14 and extend all the way through the board and out the other side. Each of the holes, such as 16, FIG. 3, contain a metal clip, such as 18, FIG. 3, which is retained in any suitable fashion, such as by the expansion retainer 20.

The board 14 is made of a non-conductive material, such as fiberboard, and the metal clip 18 is made of a material which will carry an electric current. The expansion retainer 20 may be annular and be made of a resilient plastic material which is in interference fit with the metal clip 18 and which forces the clip into engagement with the portion of the board 14 defining the hole 16 so that the metal clip is retained therein.

Each hole has a metal clip as shown in FIG. 2. However, only some of the metal clips are electrically connected to a power source. In FIG. 1 I have illustrated by black dots those holes which have metal clips in them which are electrically connected and by open dots those holes which have metal clips in them which are not electrically connected.

In FIG. 2 I shown the electric connections schematically illustrated by the dash lines and symbols under the portion of the board 12 and by the remaining lines which schematically illustrate a power source designated generally 22 and a signal device designated generally 24. I have also illustrated that the electrical leads from the power source and signal device may be connected to other clips at other portions of the board, as for example, illustrated by the broken leads and the bracket indicating that these leads go to other squares.

It is to be understood that what is illustrated is a means of wiring, that is, electrically connecting, some of the metal clips to the power source and to the alarm device for purposes which will become apparent. It is also to be understood that while this means is shown, it is shown for purposes of illustration only, and other electrical methods and apparatuses could be provided within the scope of my invention.

Figure 4:
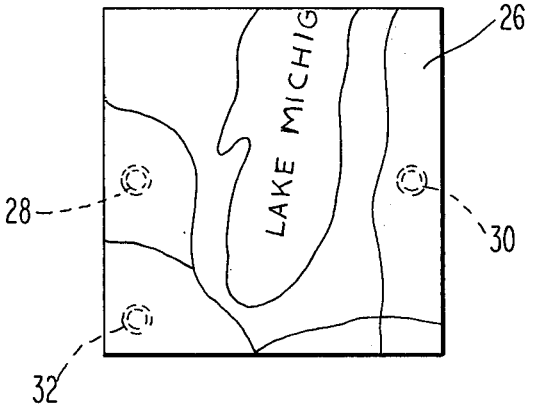
FIG. 4 is a plan view of a playing piece showing indicia on the face thereof.
Figure 5:
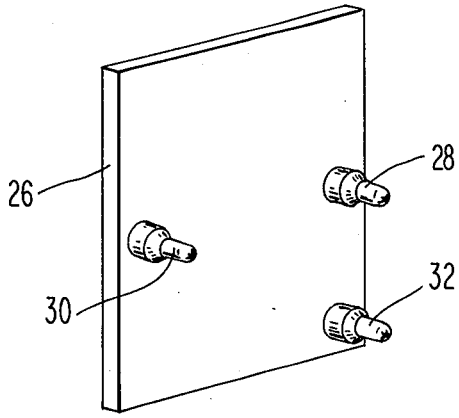
FIG. 5 is a perspective view taken from the rear showing the right side and top edge of the playing piece shown in FIG. 4.

For purposes of illustrating the effect of these connections, I have shown a playing piece in FIG. 4. The piece 26 is shown in rear perspective view in FIG. 5. This piece is adapted to be positioned over the area 12 on the playing surface; which, in accordance with the indicia thereon, is the only correct area on the surface for this piece. When so positioned, the prongs 28, 30 and 32 on the rear of the piece are inserted into the holes 34, 36 and 16 respectively by pushing down on the upper surface of the piece 26. The prongs may be made of any suitable material so as to fit snugly into the holes in the playing board and yet be readily removable therefrom. Thus, they act to physically position the piece with respect to the surface. Further, they must be such as to electrically connect the two portions of the clip in the hole for purposes of completing a circuit. Thus, the prongs may be made of a suitable plastic material which has been metallically coated. The metallic coating is a contact means which, together with the two separate portions of the clip 18, closes the switch means to complete a circuit and set off the alarm.

Since the piece 26 is in the correct position over the playing surface portion 12, there will be no electrical connection and no signal. Note that the prongs fit into the three holes which have electric clips which have not been connected to the signal device 24 (denomicated ALARM DEVICE in FIG. 2).

If the piece 26 were placed over any of the other areas of the board illustrated in solid lines in FIG. 1, then an electrical connection would be made, that is, a circuit would be completed between the power source 22 and the signal device 24, thereby setting off the signal means. The signal device may be a light which is turned on or a buzzer or the like. Such an electric connection is shown being made by the prong 46 illustrated in FIG. 3. Therein, a prong has been inserted into the hole 40 and has completed the electric connection between the portion 42 of the clip and the portion 44 thereof by means of the coating on the prong 46. The wires 50 and 52 illustrate the means for selectively electrically connecting the alarm device and power source. Of course, as previously pointed out, other types of electrical switch means, such as printed circuits and the like, could be provided within the scope of this invention.

To determine the number of areas you can put on a board in accordance with this invention, the following mathematical formula should be used $$x = n!/[(n-m)!]m!$$

where:

$x$ = the areas you can put on the board, that is, the maximum number of combinations of prongs and non-electrically connected holes $n$ = the number of holes or sockets in the board per area $m$ = the prongs on the back of each playing piece For example, if the number of sockets in each playing area is six and the number of prongs on each playing piece is two, then the maximum number of combinations is equal to $$x = 6!/[(6-2)!]2! = 15$$

In the matrix illustrated in FIG. 1 there are 45 squares. If each square area on the board had eight sockets, as shown in the illustration, and you wished to use three prongs, as shown on the piece illustrated in FIGS. 4 and 5, then there is a possibility of having 46 combinations, or more than enough to cover the 45 squares shown without repeating the disposition of the electrically connected holes to pieces with contacts on them.

The holes are arranged in a uniform pattern at uniform spacing, as are the pins. Thus any three pin matrix can be physically positioned anywhere on the board. The pieces, of course, need not be identical in size or shape; although they may be.

Thus, I have provided a wide and variable range within which to adjust the number of areas and playing pieces to suit the particular needs of the game or educational device contemplated. Such a device could readily be adapted for use in teaching children to properly identify information from given groups or categories which have been aligned in columnar or matrix form, such as, for example, presidents of the U.S. and the like.

It will be understood that various changes in the details, materials and arrangement of parts which have been herein described and illustrated in order to explain the nature of this invention may be made by those skilled in the art within the principle and scope of the invention as expressed in the following claims.

It is obvious, for example, that there could be more than one pin-hole pattern, spacing, or size, repeat combination in the same game set. This would merely be repetitive of the concept of the present invention.

It will be further understood that the Abstract of the Disclosure set forth above is intended to provide a non-legal technical statement of the contents of the disclosure in compliance with the Rules of Practice of the U.S. Patent Office, and is not intended to limit the scope of the invention described and claimed herein.

What is claimed is:

1. An electric game set, comprising:

a. means providing a surface having indicia thereon defining distinct areas;

b. a plurality of pieces adapted to be positioned on said surface, each piece having indicia thereon relating to the correct location of said piece on a predetermined area on said surface;

c. electrical means associated with each of the areas on said surface, said electrical means comprising signal means and switch means coacting with said signal means to produce a signal upon closing of said switch means; said switch means being engaged with said means providing a surface and being proximate to each of said areas;

d. each of said pieces having contact means associated therewith adapted to coact with said switch means upon appropriate predetermined positioning thereof to close said switch means and thereby to actuate said signal means to produce a signal; the switch means and contact means being arranged with respect to said areas such that said contact means will not coact with said switch means as aforesiad when said piece is correctly positioned with respect to said surface;

e. said pieces and said means providing a surface each having means which coact to physically position said pieces with respect to said surface, comprising a plurality of holes in said surface disposed in a uniform pattern on each of said areas and a plurality of prongs on said pieces for insertion into said holes;

f. each of said holes containing a plurality of electric contacts for coacting with said contact means on said pieces; said contacts being selectively connected to said signal means; and g. the holes in each of said areas which contain electrical contacts which are not connected to said signal means, bearing a relationship to the contact means associated with each of said pieces to perform the functions as set forth above in accordance with the following formula $$x = n!/[(n-m)!]m!$$

where:

$x$ = the areas on the board $n$ = the number of holes in the board per area $m$ = the number of contact means associated with each of said pieces.

2. An electric game set, comprising:

a. means providing a surface having indicia thereon defining distinct areas;

b. a plurality of pieces adapted to be positioned on said surface, each piece having indicia thereon relating to the correct location of said piece on a predetermined area on said surface;

c. electrical means associated with each of the areas on said surface, said electrical means comprising a signal means and switch means coacting with said signal means to produce a signal upon closing of said switch means; said switch means being engaged with said first mentioned means providing a surface and being proximate to each of said areas; and d. each of said pieces having contact means associated therewith adapted to coact with said switch means upon appropriate predetermined positioning thereof to close said switch means and thereby to actuate said signal means to produce a signal; the switch means and contact means being arranged with respect to said areas such that said contact means will not coact with said switch means as aforesaid when said piece is correctly positioned with respect to said surface; the prearrangement of switch means and contact means with respect to said areas being such that the switch means associated with each of said areas, bear a relationship to the contact means associated with each of said pieces to perform the functions as set forth above, in accordance with the following formula $$x = n!/[(n-m)!]m!$$

where:

$x$ = the areas on the board $n$ = the number of switch means per area $m$ = the number of contact means associated with each of said pieces.

* * * * *